US005938213A

United States Patent [19]

Gignoux

[11] Patent Number: 5,938,213

[45] Date of Patent: Aug. 17, 1999

[54] IN-LINE ROLLER SKATES

[76] Inventor: Pierre Gignoux, La Faurie, 38700 Le Sappey-En-Chartreuse, France

[21] Appl. No.: 08/820,229

[22] Filed: Mar. 18, 1997

[30] Foreign Application Priority Data

Mar. 28, 1996 [FR] France ..... 96 04130

[51] Int. Cl.[6] ..... A63C 17/14

[52] U.S. Cl. ..... 280/11.2; 188/29; 280/11.22

[58] Field of Search ..... 280/11.2, 11.22; 188/29

[56] References Cited

U.S. PATENT DOCUMENTS

| | | | |
|---|---|---|---|
| 5,192,099 | 3/1993 | Riutta | 280/11.2 |
| 5,388,844 | 2/1995 | Pellegrini, Jr. | 280/11.2 |
| 5,403,021 | 4/1995 | Shifrin | 280/11.2 |
| 5,411,276 | 5/1995 | Moldlenhauer . | |
| 5,435,579 | 7/1995 | Pozzobon . | |
| 5,462,296 | 10/1995 | Pozzobon . | |
| 5,465,984 | 11/1995 | Pellegrini, Jr. et al. . | |
| 5,511,803 | 4/1996 | Klukos | 280/11.2 |
| 5,639,104 | 6/1997 | Haldemann | 280/11.2 |
| 5,769,433 | 4/1996 | Zorzi | 280/11.2 |

FOREIGN PATENT DOCUMENTS

| | | |
|---|---|---|
| 0 568 878 | 11/1993 | European Pat. Off. . |
| 0 600 274 | 6/1994 | European Pat. Off. . |
| 0 681 856 | 11/1995 | European Pat. Off. . |
| WO 96/01139 | 6/1995 | WIPO . |

*Primary Examiner*—Lanna Mai
*Assistant Examiner*—Jeff Restifo
*Attorney, Agent, or Firm*—Bugnion S.A.; John Moetteli

[57] ABSTRACT

A skate comprising a chassis (1) equipped with at least two rollers (5, 6, 7, 8) and with a boot whose upper (2), optionally fitted with a collar (3) articulated in the malleolar region (4), can be tilted rearward. The skate further comprises a brake (18), acting on the two rearmost rollers (7, 8) and secured to a lever (9) which is articulated via one of its ends (10) on to the chassis (1), in front of the penultimate roller (7), and is actuated by the tilting of the upper (3) of the boot by means of a bar (12) or a pusher. The brake preferably consists of a pair or disks which are driven by the rollers and brake when in contact.

10 Claims, 3 Drawing Sheets

IN-LINE ROLLER SKATES

FIELD OF THE INVENTION

The present invention relates to an in-line roller skate, comprising a chassis on which, on the one hand, at least three rollers and, on the other hand, a boot are mounted, the upper of which boot, optionally fitted with a collar is capable of tilting rearward relative to the chassis, and a brake, mounted on a support articulated on to the chassis about an axle parallel to the axle of the rollers and actuated by the rearward tilting of the upper, or of its collar.

The term "upper" will be used hereafter to denote either an upper equipped with a collar or a collarless upper.

PRIOR ART

Skates of this type are described in U.S. Pat. Nos. 5,435,579, 5,462,296 and 5,465,984, and in patent EP 681,856. All these skates comprise a brake which consists of a shoe, mounted at the rear of the skate and intended to brake by friction on the ground. This shoe is articulated to the rear of the chassis and is actuated directly by the collar which is articulated on to the upper of the boot, via a push bar. Braking requires considerable effort on the part of the leg. In addition, when passing over an obstacle, in particular when descending a staircase or sidewalk step, the shoe generally impinges on the step, which not only causes inappropriate braking but results in a shock to the lower leg.

Patent application WO 96/01,139 discloses a skate comprising a brake that also consists of a shoe mounted at the end of a double L-lever at the rear of the chassis bearing the rollers, this lever being articulated on to the axle of the penultimate roller and having an arm which is connected to a collar surrounding the skater's leg, above the boot.

In addition, patent EP 0,600,274 discloses an in-line roller skate equipped with a brake consisting of a shoe which is articulated about a horizontal axle between the two rear rollers and is connected, on one side, to the collar of the boot by a tension cable and, on the other side, to a return spring, so that it brakes on the rear roller when the leg flexes forward, and so that it brakes on the penultimate roller when the leg flexes rearward.

SUMMARY OF THE INVENTION

The object of the invention is to produce a brake which is fully integrated with the chassis and can be actuated by the upper of the boot with less effort and in a more easily controlled fashion.

The skate according to the invention is one wherein the brake support is a second-class lever which extends above the two rear rollers and one end of which is articulated on to the chassis at a point located in front of the rear roller, and the other end of which is connected to the rear of the boot, wherein the brake is located above the axles of the rollers, so that the rearward tilting of the upper of the boot, or of its collar, has the effect of applying the brake on the two rearmost rollers in an at least approximately vertical direction.

The brake preferably acts simultaneously on the two rear rollers. It advantageously consists of a pair of disks which are mounted so as to rotate and have facing faces which are frustoconical in order to be driven by the rollers, braking taking place by friction on the walls of the chassis.

Since the chassis generally consists of a U-shaped profiled part, the lever and the brake may be mounted inside the chassis. A brake of this type is fully integrated with the chassis.

In contrast to the shoe braking on the ground, at the rear, the brake of the skate according to the invention may have a substantially shorter travel, which makes it possible to obtain braking with reduced displacement of the upper of the boot, that is to say reduced displacement of one of the skates forward relative to the other skate.

BRIEF DESCRIPTION OF THE DRAWINGS

The appended drawing represents, by way of example, several embodiments of the invention.

DESCRIPTION OF THE PREFERRED EMBODIMENTS

Figure 1:
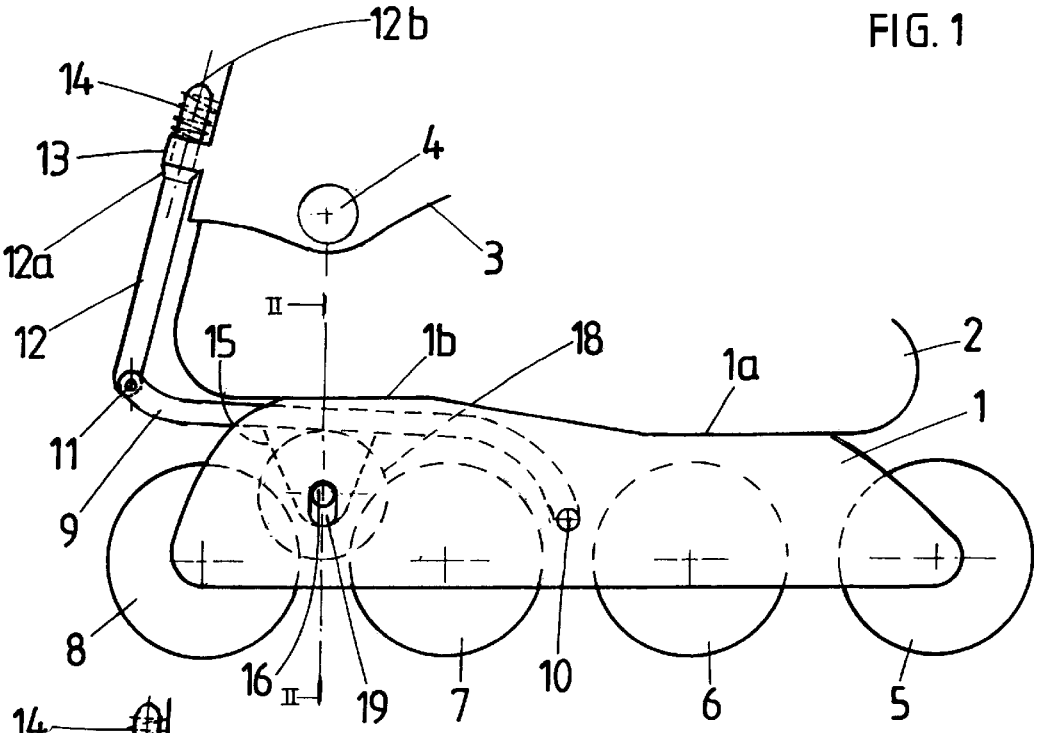
FIG. 1 is a side view, in the unbraked position, of a first embodiment.
Figure 3:
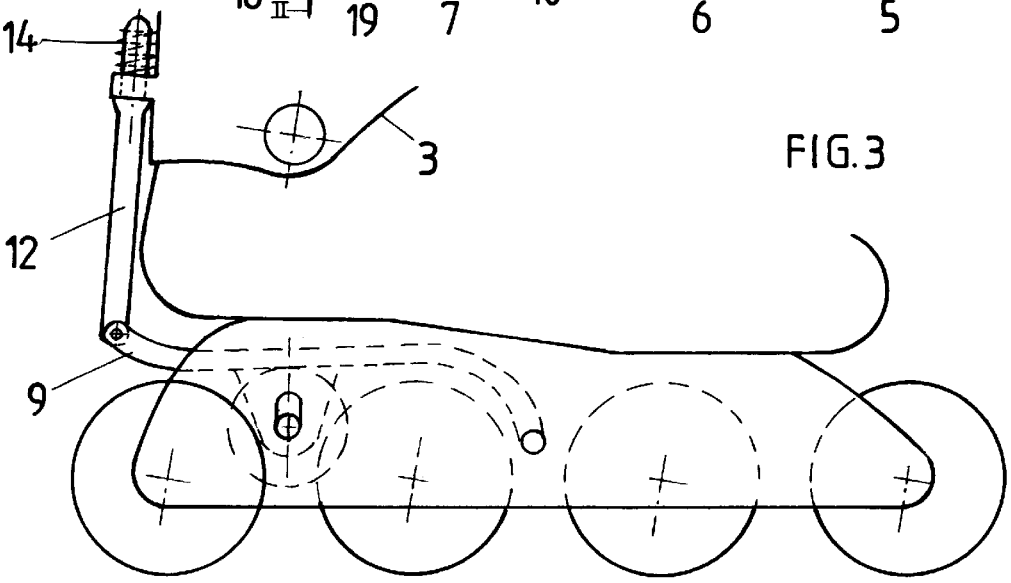
FIG. 3 represents the same skate in the braked position.
Figure 2:
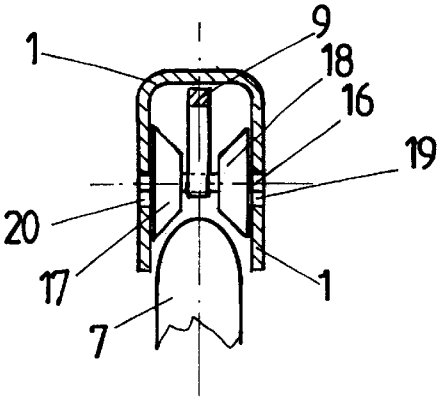
FIG. 2 is a partial sectional view on II—II in FIG. 1.

The skate represented in FIGS. 1 to 3 comprises a chassis 1, for example made of aluminum, which has a profile in the shape of an inverted U, forming two platforms la and lb on which a boot is fixed, this boot comprises an upper 2 having an ankle portion on to which a collar 3 is articulated about an axle 4 in the malleolar region, this collar being intended to surround the ankle. The chassis 1 is fitted with four in-line rollers 5, 6, 7, 8. Between the rollers 6 and 7, approximately at the center of the chassis and between the sides thereof, a lever 9 is articulated, via one of its ends, about an axle 10 which is parallel to the axles of the rollers and is mounted between the sides of the chassis 1. The other end of the lever 9 is articulated, at a point 11, to the end of a bar 12 which, via a support zone 12*a*, bears on a bracket 13 of the collar 3 of the boot. The bar 12 passes through the bracket 13 by means of a part 12*b* surrounded by a spring 14 which works in compression between a stop, secured to the part 12*b*, and the bracket 13.

In its part located inside the chassis 1, the lever 9 is fitted with a support 15 which is directed downward and bears a transverse axle 16 parallel to the axles of the rollers. Two identical disks 17 and 18, having frustoconical facing faces and plane outer faces fitted with a brake lining, are mounted so as to rotate on this axle 16. The ends of the axle 16 are engaged in two vertical slots 19 and 20 which are formed in the chassis 1, equidistant from the axles of the two rear rollers 7 and 8.

When the collar of the boot tilts rearward, the bar 12 actuates the lever 9, which has the effect of applying the frustoconical faces of the disks 17 and 18 on to the rollers 7 and 8. The disks 17 and 18 are separated by these rollers and are applied against the sides of the chassis 1, while being rotated by the rollers. Braking takes place by friction against the chassis. When the collar 3 is returned to its initial position, the spring 14 moves the bar 12 upward, and the lever 9 with it. The disks no longer bear on the rollers and are therefore no longer rotated.

The slots 19 and 20 can be used to guide the axle 16 along the perpendicular bisector of the line joining the axles of the rollers 7 and 8. The axle 16 could therefore be mounted with lateral play in the support 15, for example in a horizontal slot. The articulation axle 10 of the lever 9 could then be moved closer to the brake, above the roller 7, so as to increase the lever effect, while keeping an equal pressure on the rollers 7 and 8.

The lever 9 and the bar 12 could be made in a single piece having sufficient flexibility at the bend corresponding to the articulation 11.

Figure 4:
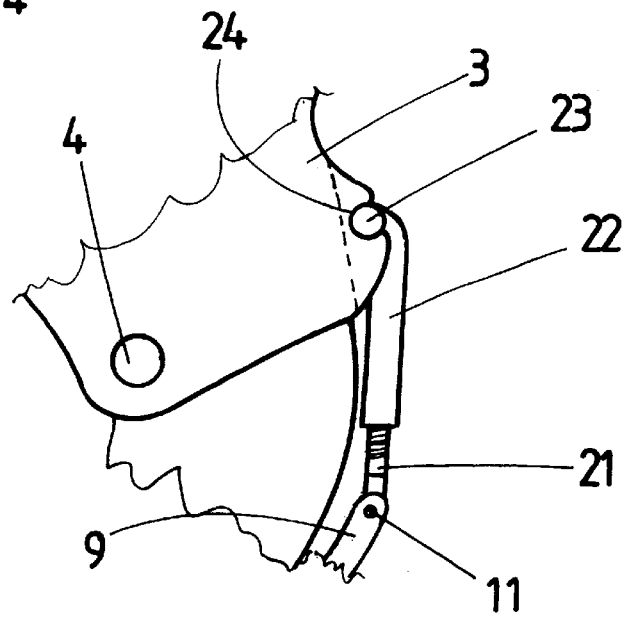
FIG. 4 is a partial view of a second embodiment.

If the boot is removably fixed to the skate, the linkage between the lever 9 and the boot must therefore be detachable. One embodiment which meets this requirement is represented partially in FIG. 4, the part which is not represented being identical to FIG. 1. The lever 9 is articulated to a screw-threaded bar 21 screwed in to a sleeve 22 which, at its upper end, is fitted with a small transverse cylindrical bar 23. This small bar engages, with some degree of constraint, in a housing 24 in the collar 3, forming an attachment notch and articulation for the sleeve 22. The small bar 23 is inserted in to its housing 24 simply by pressure, and it can be withdrawn from its housing by simply pulling radially on the small bar 23. Separation of the collar and the sleeve 22 is also carried out in order to adjust the length of the link, formed by the bar 23 and the sleeve 22, by rotating the sleeve 22.

Figure 5:
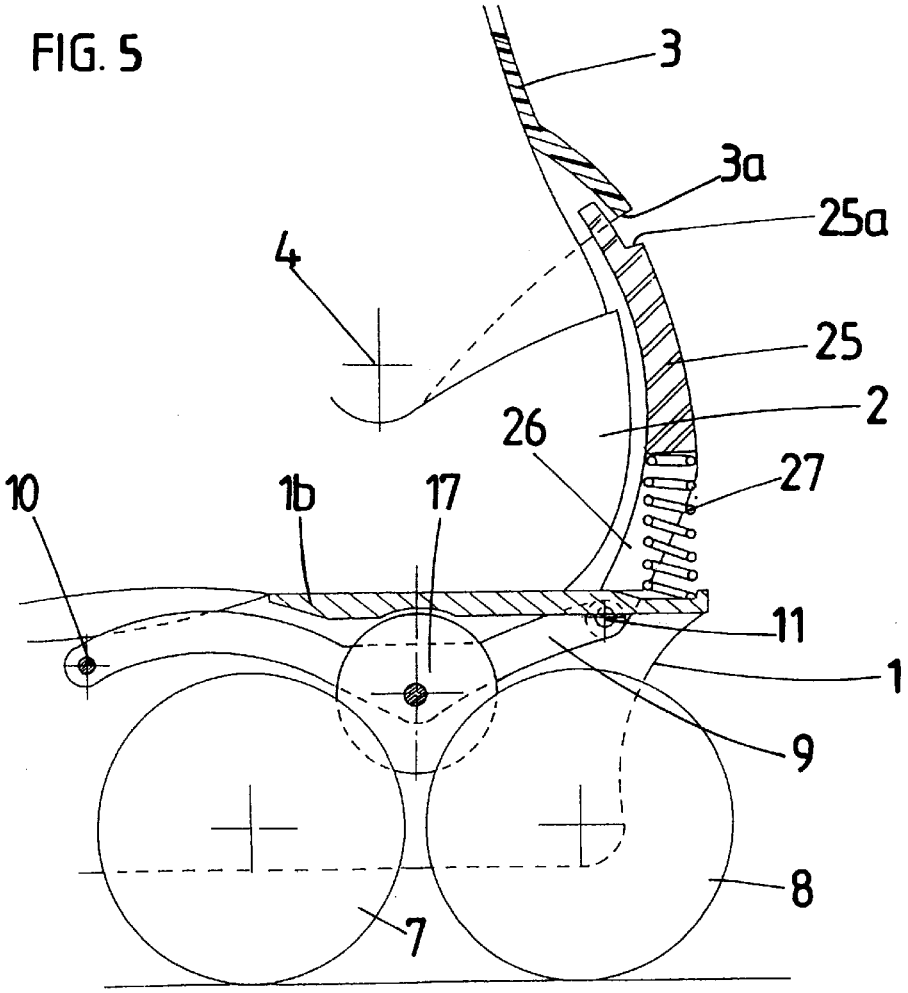
FIG. 5 is a partial view of a third embodiment.

Instead of a detachable link, it is also possible to actuate the lever by the collar without a linkage. One embodiment which meets this requirement is represented in FIG. 5.

The lever 9 is not connected to the boot, but to a transmission part 25 extending to the rear of the boot, above the platform 1*b*, in the direction of the collar 3 and matching the rounded shape of the upper 2. This part 25 has a cutout 26 which accommodates a spring 27, working in compression between the bottom of the cutout and the platform 1*b*. The part 25 is retained by the lever 9, the articulation 11 of which abuts against the platform 1*b*. Retention could also be effected by the disks 17 and 18 abutting against the platform 1*b*. When it tilts rearward, the collar 3 abuts on a support zone 25*a* of the transmission part 25, via its edge 3*a*, and actuates the lever 9. The part 25 therefore has the function of a pusher.

The absence of permanent linkage between the brake and the collar also allows the latter to tilt freely, in particular forward, without being hindered by the brake.

Figure 6:
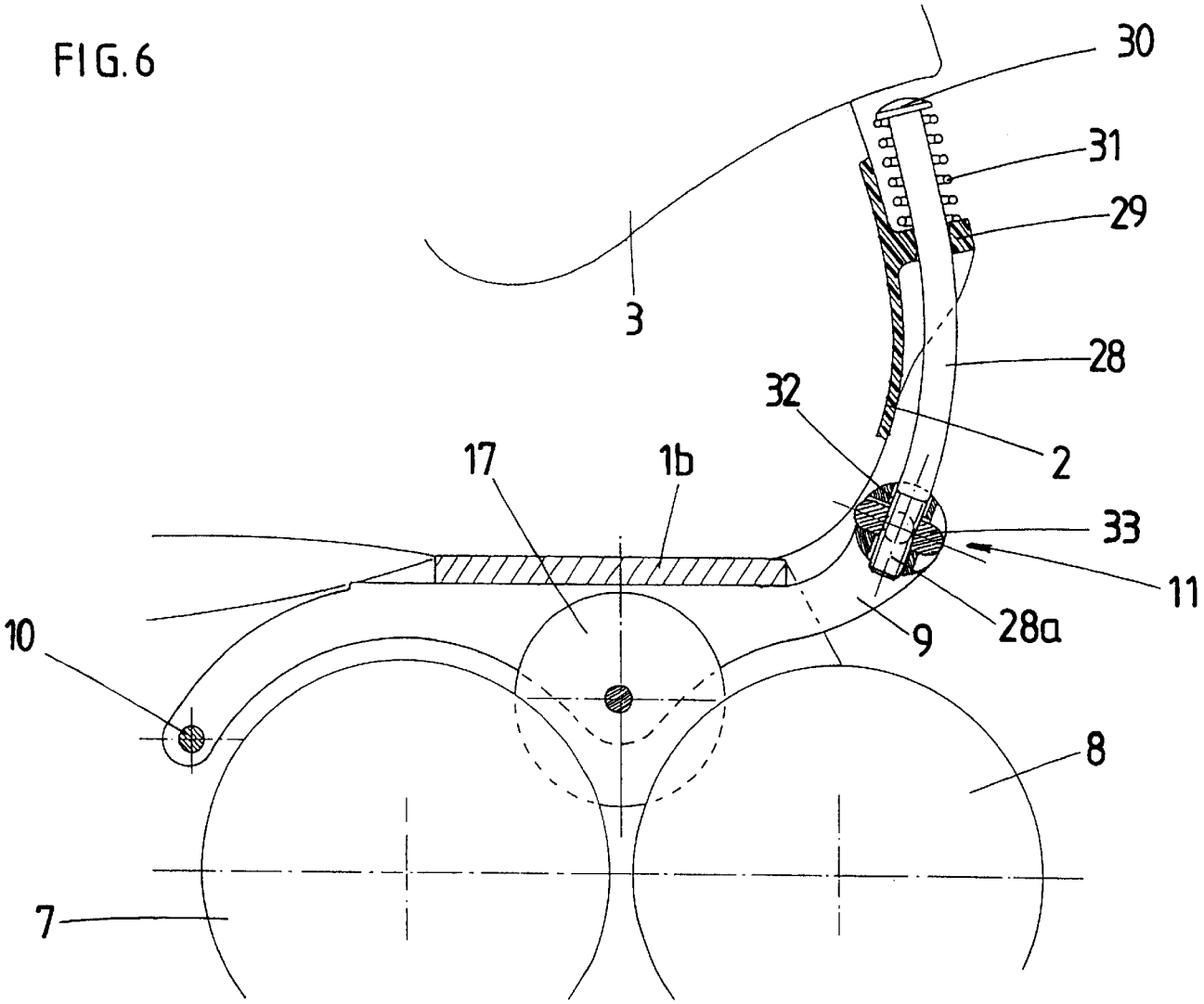
FIG. 6 is a partial view of a fourth embodiment.

In the embodiment represented in FIG. 6, the lever 9 is not connected to the collar 3, but is articulated to a push bar 28, guided through a bracket 29 of the upper 2 of the boot and fitted with a head 30. A spring 31, mounted between this head 30 and the bracket 29, holds the bar 28 and the lever 9 in an upper position. The active length of the bar 28 can be modified at its articulation 11 to the lever 9. This articulation consists of an insert 32 which is articulated between the arms of the lever 9 and is penetrated by the screw-threaded end 28*a* of the bar 28. A knurled circular nut 33, retained axially in the insert 32 according to a known design, is mounted on this bar. When it tilts rearward, the collar 3 comes to press on the head 30 and actuate the brake.

The invention is also applicable to a boot whose upper is not fitted with a collar, as long as the upper is flexible enough to allow it to tilt rearward.

I claim:

1. An in-line roller skate, comprising a chassis (1) on which at least three rollers (5,6,7,8) which support the weight of a skater during skating and a boot are mounted, each such roller being mounted to the chassis by a separate axle, the boot having an upper (2) with an ankle portion, the ankle portion having a high portion optionally fitted with a collar (3), the ankle portion being capable of tilting rearward relative to the chassis, and a brake (17, 18), mounted on a support (9) which is articulated onto the chassis and actuated by the rearward tilting of the ankle portion, wherein the brake support is a lever (9) which extends above the two rearmost rollers (7, 8), one end of the brake support being articulated onto the chassis at a point (10) located in front of the two rearmost rollers, and the other end (11) of which is operatively connected to the rear of the ankle portion of the boot, and wherein the brake (17, 18) is located above the axles of the two rearmost rollers, so that the rearward tilting of the ankle portion of the boot has the effect of moving the brake in a substantially vertical direction for applying the brake to the two rearmost rollers.

2. The skate as claimed in claim 1, wherein the brake consists of at least one axisymmetric body mounted on an axle (16) engaged in two vertical slots (19, 20) in the chassis.

3. The skate as claimed in claim 2, wherein the brake consists of a pair of disks (17, 18), mounted so that they are free to rotate and translate on the axle (16), the facing faces of these disks being at least approximately frustoconical, and the opposite faces being fitted with a brake lining which interacts with the chassis (1) in order to effect braking.

4. The skate as claimed in claim 1, comprising at least three rollers, wherein the brake is located between the two rear rollers (7, 8), so as to brake simultaneously on these two rollers.

5. The skate as claimed in claim 1, wherein the lever is connected to the upper (2) of the boot, or to its collar (3), by a bar (12; 21) articulated on to the lever.

6. The skate as claimed in claim 5, wherein the bar (21) is screw-threaded and connected to the upper, or to its collar, by means of sleeve (22) screwed on to the screw-threaded bar.

7. The skate as claimed in claim 6, wherein the sleeve (22) is releasably attached to the upper, or to the collar.

8. The skate as claimed in claim 1, in which the upper (2) of the boot is fitted with a collar (3), wherein the lever (9) is connected to a bar (28) which is guided by the upper of the boot and held elastically (31) in an upper position, the collar (3) abutting against the upper end of this bar when it tilts rearward, and pushing on the bar.

9. The skate as claimed in claim 8, wherein the bar (28) is connected to the lever (9) by an articulation with an insert (32) and nut (33), making it possible to modify the active length of the bar.

10. The skate as claimed in claim 1, wherein the lever (9) is connected to a transmission part (25) extending above the chassis (1), this transmission part being held in an upper position by an elastic means (27), the upper (2), or its collar (3), abutting on this transmission part and actuating the brake, when it tilts rearward.

* * * * *

UNITED STATES PATENT AND TRADEMARK OFFICE

CERTIFICATE OF CORRECTION

PATENT NO. : 5,938,213

DATED : AUGUST 17, 1999

INVENTOR(S) : GIGNOUX

It is certified that error appears in the above-identified patent and that said Letters Patent is hereby corrected as shown below:

On the front page, column 1, between listed item "[76]...France" and "[21]", please insert:

Signed and Sealed this

Thirteenth Day of June, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 5,938,213

DATED : August 17, 1999

INVENTOR(S) : Gignoux

It is certified that error appears in the above-identified patent and that said Letters Patent is hereby corrected as shown below:

On the front page, column 1, between listed item "[76] ...France" and "[21]", please insert:

--[73] Assignee: Skis Rossignol S.A., Voiron, France--

This certificate supercedes certificate of correction issued June 13, 2000.

Signed and Sealed this

Thirteenth Day of February, 2001

*Attest:*

Nicholas P. Godici

NICHOLAS P. GODICI

*Attesting Officer*

*Acting Director of the United States Patent and Trademark Office*